US007390602B2

(12) United States Patent
Reeves

(10) Patent No.: US 7,390,602 B2
(45) **Date of Patent: *Jun. 24, 2008**

(54) PHOTOCONDUCTOR WITH PROTECTIVE OVERCOAT

(75) Inventor: Scott Daniel Reeves, Louisville, CO (US)

(73) Assignee: Lexmark International, Inc, Lexington, KY (US)

( * ) Notice: Subject to any disclaimer, the term of this patent is extended or adjusted under 35 U.S.C. 154(b) by 379 days.

This patent is subject to a terminal disclaimer.

(21) Appl. No.: 11/103,015

(22) Filed: Apr. 11, 2005

(65) Prior Publication Data

US 2006/0228638 A1 Oct. 12, 2006

(51) Int. Cl.
*G03G 5/147* (2006.01)

(52) U.S. Cl. ..... 430/66

(58) Field of Classification Search ..... 430/66
See application file for complete search history.

(56) References Cited

U.S. PATENT DOCUMENTS

| | | | | |
|---|---|---|---|---|
| 3,944,520 | A | 3/1976 | Andrianov et al. | |
| 4,027,073 | A | 5/1977 | Clark | |
| 4,278,804 | A | 7/1981 | Ashby et al. | |
| 4,439,509 | A | 3/1984 | Schank | |
| 4,443,579 | A | 4/1984 | Doin et al. | |
| 4,477,499 | A | 10/1984 | Doin et al. | |
| 4,559,271 | A | 12/1985 | Doin et al. | |
| 4,565,760 | A | 1/1986 | Schank | |
| 4,595,602 | A | 6/1986 | Schank | |
| 4,606,934 | A | 8/1986 | Lee et al. | |
| 4,912,000 | A | 3/1990 | Kumakura et al. | |
| 4,917,980 | A | 4/1990 | Badesha et al. | |
| 4,923,775 | A | 5/1990 | Schank | |
| 5,731,117 | A | 3/1998 | Ferrar et al. | |
| 5,783,651 | A | 7/1998 | Konig et al. | |
| 5,874,018 | A | 2/1999 | Ferrar et al. | |
| 5,882,830 | A | 3/1999 | Visser et al. | |
| 5,910,272 | A | 6/1999 | Kushibiki et al. | |
| 5,968,656 | A | 10/1999 | Ezenyilimba et al. | |
| 6,074,756 | A | 6/2000 | Vreeland et al. | |
| 6,194,106 | B1 | 2/2001 | Bretscher et al. | |
| 6,299,799 | B1 | 10/2001 | Craig et al. | |
| 6,489,069 | B1 * | 12/2002 | Itami et al. | 430/58.2 |
| 2003/0044407 | A1 | 3/2003 | Chang et al. | |
| 2003/0195283 | A1 | 10/2003 | Lee et al. | |
| 2003/0199620 | A1 | 10/2003 | Lee et al. | |
| 2004/0121251 | A1 | 6/2004 | Yokota et al. | |
| 2006/0115755 | A1 * | 6/2006 | Bender et al. | 430/56 |

FOREIGN PATENT DOCUMENTS

| | | | |
|---|---|---|---|
| EP | 1380596 | | 1/2004 |
| JP | 02187437 A | * | 7/1990 |

* cited by examiner

*Primary Examiner*—Christopher RoDee
(74) *Attorney, Agent, or Firm*—Geoffrey Oberuaus

(57) ABSTRACT

Photoconductors are disclosed having an overcoat layer of silsesquioxane substituted with 4-[3-(triethoxysilylpropoxy]-2-hydroxybenzophenone. The degree of substitution is believed not critical. Similarly, the thickness of the coating is not critical and may vary according to the wear anticipated, as well as the electrical requirements of the specific application. Improvements are realized using this material in comparison to unsubstituted silsesquioxane.

13 Claims, No Drawings

PHOTOCONDUCTOR WITH PROTECTIVE OVERCOAT

TECHNICAL FIELD

The present invention improves the wear and erosion and other properties of a photoreceptor or photoconductor (PC) drum by utilizing a protective overcoat on top of the photoreceptor layers.

BACKGROUND OF THE INVENTION

The overcoat on a photoconductor can improve wear and erosion resistance and can mitigate crazing and lower the negative fatigue of the photoconductor drum. While numerous patents exist in the prior art (outlined below), no overcoat materials combine the advantages of wear resistance, fatigue improvements, and inhibition of crazing phenomenon.

In electrophotography, a dual layer photoconductor or photoreceptor is comprised of a charge generation layer (CGL) and charge transport layer (CTL) coated onto a suitable substrate, such as aluminized MYLAR polyester or an anodized aluminum drum. The CGL is designed for the photogeneration of charge carriers and is comprised of pigments or dyes, such as azo compounds, perylenes, phthalocyanines, squaraines, for example, with or without a polymer binder. The CTL layer, as its name implies, is designed to transport the generated charges. The CTL contains charge transport molecules, which are organic materials capable of accepting and transporting charge, such as hydrazones, tetraphenyl diamines, triaryl amines, for example.

Typically, the CTL also contains polymer binders, which are present to provide a wear resistant surface. Moreover, the polymer binders create adhesion between the layers and give a smooth surface, which can be easily cleaned.

As printers are made to perform at faster and faster print speeds, very short charge and discharge intervals are required. These faster speeds put increasingly greater demands on the PC drum and can shorten their effective useful life. In addition, the demand for smaller printer footprints puts additional constraints on the PC drum design. The PC drum may also be exposed to room light during servicing, which can cause fatigue in the PC drum.

Fatigue corresponds to the change in voltage over the life of the drum. In addition to fatigue from room light, fatigue can also result from drum cycling (repeated charge/discharge cycles) or from exposure to UV radiation, such as that emitted from a corona discharge lamp. Positive fatigue corresponds to photoconductor drums that discharge at lower voltages. For example, if a drum initially discharges to −100V, and on cycling or after exposure to room light discharges to −50V, the drum is exhibiting a positive fatigue of +50V. This positive fatigue would result in darker prints compared to the initial ones. Similarly, negative fatigue corresponds to a drum exhibiting a discharge voltage that is higher than the initial and would result in lighter prints.

Therefore, controlling the drum fatigue is important for the reproducibility of prints. The PC drum may also be more accessible to possible contamination from the environment or the user during routine maintenance. Furthermore, if smaller diameter drums are required because of space constraints, wear issues are magnified since more revolutions of the drum are required to print a page.

Silsesquioxanes have been incorporated into photoconductors as resin binders because of their abrasion resistant properties. Silsesquioxanes are compounds with the empirical chemical formula, $RSiO_{1.5}$, and can be thought of as hybrid intermediate between silica ($SiO_2$) and silicone ($R_2SiO$). Sol-gel precursors are formed by the hydrolysis of trialkoxysilanes, which are cured to a mixed cage/network, or silsesquioxane structure.

When cured at higher temperatures, part of the cage structure is transformed into a more cross-linked network structure. Because of their cross-linked network structure, these materials are hard and have useful applications as abrasion resistant coatings, which include overcoats for organic photoconductor layers. Silsesquioxane layers are harder and less permeable to chemical contaminants than typical PC layers or binders such as polyesters or polycarbonates. Furthermore, these materials are known for low surface energy, which should make them good as release coatings to aid in toner transfer.

Silsesquioxane overcoats possess many other properties that are also advantageous for photoconductors. Because of their smooth surface, silsesquioxane overcoats are expected to increase the efficiency of particle transfer from the photoconductor surface, which is increasingly important as toner particle size decreases to meet the demands of higher image resolution. In addition to their smooth and hard features, these materials can also provide protection from physical, chemical, and radiation damage. For instance, the addition of acid scavengers to keep contaminants, such as acids, from reaching the photoreceptor surface. Likewise, dyes can be added to protect the photoreceptor from fatigue, especially from room light.

To address these issues to achieve a long life PC drum, a protective top layer can be coated onto the photoconductor drum. The protective overcoat can include additives that protect against damage from handling, exposure to UV light, and from the abrasion and erosion caused from the toner, cleaner blade, charge roll, for example.

While a robust overcoat can improve the life of the PC drum, a suitable overcoat is required that does not significantly alter the electrophotographic properties of the PC drum. If the layer is too electrically insulating, the photoconductor will not discharge and will result in a poor latent image. On the other hand, if the layer is too electrically conducting, then the electrostatic latent image will spread resulting in a blurred image. Thus, a protective layer that improves the life of the photoconductor must not negatively alter the electrophotographic properties of the PC drum.

The following references are illustrative of prior art employing silsesquioxane overcoats on photoconductors: U.S. Pat. Nos. 4,565,760 to Schank; U.S. Pat. No. 4,595,602 to Schank, particularly Example V, and U.S. Pat. No. 4,606,934 to Lee Et al, particularly Examples IX and XI.

U.S. Pat. No. 4,278,804 to Ashby et al discloses selesesquioxane combined with an ultraviolet light absorbing agent which is that employed in this invention, and U.S. Pat. No. 4,443,579 to Doin et al. discloses that agent chemically combined such that the material does not require a primer for overcoating. The material of this patent to Doin et al. is identical or substantially identical to the commercial material employed to practice this invention. Neither the Ashby et al. nor Doin et al. teaches overcoating a photoconductor. Silsesquioxane overcoats with UV absorbers have prevented the deterioration of polycarbonates from UV rays and are widely used in the automotive industry.

DISCLOSURE OF THE INVENTION

This invention employs an overcoat layer of silsesquioxane substituted with a benzophenone group. Having the following general formula:

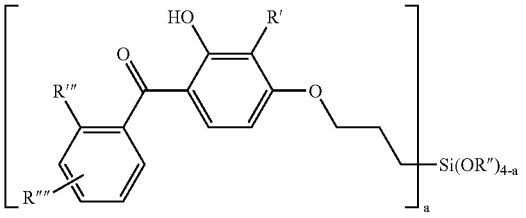

where R' is hydrogen, C1-C8 alkyl or halogen, R''' and R'''' are hydrogen, C1-C8 alkoxy, carboxy, halogen, hydrogen, amino, carbethoxy, or -Q-(CH2)3Si(OR")3; Q is —NH— or —O—; R" is C1-C8 alkyl; and a is an integer equal to 1-3 inclusive.

Specifically. the material obtained commercially is 4-[3-(triethoxysilylpropoxy]-2-hydroxybenzophenone chemically bonded in silsesquioxane These compounds can be made in accordance with the descriptions in the foregoing U.S. Pat. Nos. 4,278,804 and 4,443,579.

The degree of substitution is believed not critical, while the preferred degree of substitution is about one of the foregoing benzophenone groups for every 4 to 10 methyl groups in the silsesquioxane. Similarly, the thickness of the coating is not critical and may vary according to the wear anticipated, as well as the electrical requirements of the specific application. Exceptional and unexpected improvements are realized using this material in comparison to unsubstituted silsesquioxane.

DESCRIPTION OF PREFERRED EMBODIMENTS

General preparation of silsesquioxane:

$$\text{“}SiO_2\text{”} + RSi(OR')_3 \rightarrow RSiO_{1.5} \qquad \text{(empirical formula)}$$

Where R' is an alkoxy group (methoxy, ethoxy, etc.) and R is typically an organic group (and/or an additional alkoxy group).

“$SiO_2$” can be an aqueous suspension of silica or formed in situ from $Si(OCH_2CH_3)_4$ (tetraethyl orthosilicate; TEOS). Synonyms for TEOS include tetraethoxysilane and orthosilicic acid tetraethyl ester. The reaction proceeds by hydrolysis of the alkoxysilane groups to form an alcohol and a Si—O—Si linkage.

Silsesquioxanes are highly cross-linked materials with the empirical formula $RSiO_{1.5}$. They are named from the organic group and a 1.5 (sesqui) stoichiometry of oxygen to silicon. A variety of representations have been made to represent the structure. Below are two of the simplest three-dimensional representations (see U.S. Pat. No. 3,944,520 to Andrianov et al.). The silsesquioxane is referred to as methylsilsesquioxane (MSQ) when the R groups are methyl groups.

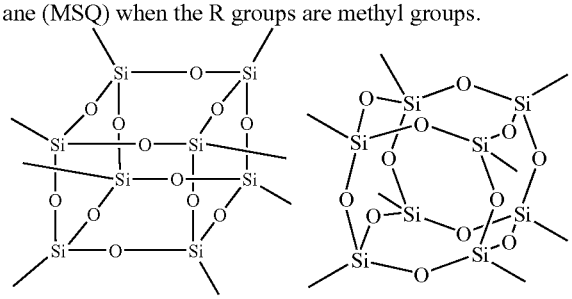

Which also is described by the following:

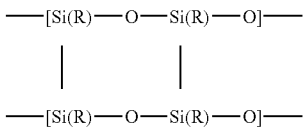

Note that silsesquioxanes can also be referred to as T-resins because each silicon has three oxygen atoms. Thus, $T_8$ refers to eight of these groups. The foregoing three-dimensional diagrams are two representations of a $T_8$ cube where R=methyl.

$$(CH_3SiO_{1.5})_8(T_8)$$

The prior art typically employs a combination of T (tri) and Q (quat) groups to form a modified silsesquioxane network. Note that these materials are still generally referred to as silsesquioxanes.

$$SiO_2 + CH_3Si(OCH_2CH_3)_3 \xrightarrow[\text{MSQ resin}]{} (CH_3SiO_{1.5})_x(SiO2)_y$$

In this case, the hydrolysis results in ethanol as a condensation byproduct.

In accordance with a specific embodiment of this invention, the UV absorber added as a substituent to the silsesquioxane is 4-[3-(triethoxysilylpropoxy]-2-hydroxybenzophenone (SHBP) which has the following nomenclature and structure:

$$C_6H_5C(O)C_6H_3(OH)—O(CH_2)_3Si(OCH_2CH_3)_3$$

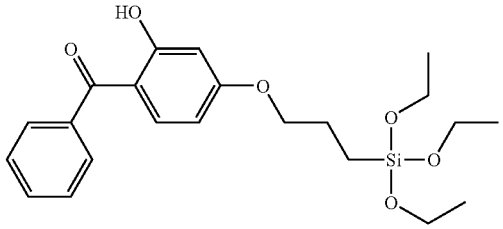

By adding this compound to the reaction of the foregoing mixture when undergoing hydrolysis this compound is cross-linked into the silsesquioxane resin. In effect, the organic UV absorber group replaces some of the methyl groups in the resin.

This invention is to the use of the substituted silsesquioxane overcoats to improve the life of the photoconductor drum without negatively altering the electrophotographic properties of the PC drum. This major development includes the improvement of the wear and erosion properties of the PC drum resulting in a PC drum with much longer life.

Wear can be caused by a variety of factors which include contact with the cleaner blade, paper, or intermediate transfer member (ITM) or by erosion or scratching from toner components. The robustness of the PC drum is due to the cross-linked silsesquioxane structure, which is much harder than polyester or polycarbonate coatings. Tests also show less fatigue during drum cycling, both during electrostatic cycling and during hot/cold fatigue tests on a printer. Electrical measurements made immediately after printing are referred to as “hot” measurements while those made after the PC drum is allowed to cool for at least 4 hours are referred to as “cold” measurements.

The presence of an ultraviolet absorber, a benzophenone, chemically linked to the silsesquioxane, may inhibit room light fatigue and improve the electrostatic cycling of the PC drum. The overcoat also mitigates crazing as exemplified by inhibiting oils or lotions from reaching the CT layer during drum handling. In crazing, small micro-cracks form in a direction perpendicular to the applied stress.

EXAMPLE 1

75 grams of 20 wt. % solution of AS4000 from GE Silicones, a silsesquioxane precursor solution in a mixture of n-butanol, isopropanol, and methanol, comprised of the reaction products of 2-hydroxy-4-(2-propenyloxy)phenylphenylmethanone with silica, trimethoxymethylsilane hydrolysis products, and triethoxysilane, was diluted with 225 grams of isopropanol to form a 5 wt. % solution. Photoconductor drums consisting of a CTL over a CGL on an anodized Al core were then coated with the diluted solution and cured at 100° C. for 1 hour.

An eddy current test system was used to measure the film thickness to be between 0.5 and 1.0 μm. These measurements utilize high-frequency alternating current, which effects an electrically conductive surface to cause highly localized current flow or eddy currents. Two overcoated drums were tested in a Lexmark C750 color laser printer. The drums, tested in a two page and pause mode, showed good print quality with minimal PC wear over 23,979 pages. The drums showed minimal wear and little or no change in film thickness. The wear was determined to be 0.00 and 0.03 μm per 1000 pages respectively for each PC drum. This compares very favorable to a control sister drum without the overcoat layer (identical CG and CT layers), where the wear rate was determined as 0.73 μm per 1000 pages.

Similarly, tests show little change in film thickness of the coated drum after 23,979 pages were printed in a two page and pause print mode. Corresponding tests of uncoated drum shows extensive loss of thickness after 20,084 pages. Specifically, the final thickness of the uncoated drum was about 8 microns, while the original thickness was about 28 microns. In contrast the final thickness of the coated drum according to Example 1 was about 23 microns, while the original thickness was also about 28 microns.

EXAMPLE 2

75 grams of 20 wt. % solution of PHC587 from GE Silicones, a silsesquioxane precursor solution in a mixture of n-butanol, isopropanol, and methanol, comprised of the reaction products of 2-hydroxy-4-(2-propenyloxy)phenylphenylmethanone with silica, trimethoxymethylsilane hydrolysis products, and triethoxysilane, was diluted with 225 grams of isopropanol to form a 5 wt. % solution. Photoconductor drums consisting of a CTL over a CGL on an anodized Al core were then coated with the diluted solution and cured at 100° C. for 1 hour. An eddy current test system was used to measure the film thickness to be between 0.5 and 1.0 μm.

Crazing Test. Both an overcoated drum from Example 1 and a standard photoconductor drum (no overcoat) as a control, which contained N,N'-Bis-(3-methylphenyl)-N,N'-bis-phenylbenzidine (TPD) in the CTL, were tested for crazing. An accelerated experiment was conducted at 60° C. in an oven by two techniques: 1) touching the PC drum surface with a finger and 2) putting a drop of hand lotion on the PC drum. The CTL of the overcoated PC drum was protected from crazing, presumably by inhibiting contact or penetration of the oils or lotion with the CTL. On the other hand, the CTL of the uncoated PC drum crazed within a few hours.

Hot/Cold Fatigue Results. Hot and cold fatigue results in a monochrome laser printer did not show typical hot/cold variation for the coated drums of this invention, while such variation is normally present in the uncoated drums. "Hot" measurements were made immediately after every 10,000 prints while "cold" measurements were made after cooling/resting the PC drum for a minimum of four hours. For the first 20,000 pages a zigzag pattern was very apparent for the uncoated drum, while the coated drum, while the coated drum showed a smooth wave slightly opposite to the zigzag of the uncoated drum. Both drums acted similarly at between 30,000 and 60,000 pages printed.

The foregoing U.S. Pat. No. 4,278,804 teaches that scratch resistant coatings for primed transparent plastics can be made more resistant to discoloration upon exposure to ultraviolet light. The synthesis of ultraviolet screening compounds, which can be used in silicon coating composition, is described in Example 1. This patent also illustrates the preparation of methylsilsesquioxane coating compositions (Example 5) which are comparable to those utilized in the current invention disclosure. Example 5 also describes the application of these coatings on transparent LEXAN® poly(bisphenol-A carbonate) panels that were primed with a thermosetting acrylic emulsion (Rohm & Haas 4% RHOPLEX).

The foregoing U.S. Pat. No. 4,443,579 teaches the preparation of similar silicone coating compositions that also contain these ultraviolet screening compounds, which do not require a primer for coating plastic substrates.

In the foregoing Examples 1 and 2 of this specification, two silicone hardcoat products from GE Silicones have been diluted with IPA and utilized as overcoat materials for photoconductors without a primer layer. One product, AS4000, is a material that, according to GE Silicones, requires a primer layer to adhere to polycarbonate. In the current invention, the AS4000 material adheres well to a charge transport layer on a photoconductor drum. The other product, PHC587, does not require a primer layer to adhere to polycarbonate. This material was utilized as a photoconductor overcoat and behaved very similarly to the AS4000 material. Both materials were coated on charge transport layers with various polycarbonate resins, specifically, formulations containing poly(bisphenol-A carbonate), poly(bisphenol-Z carbonate), and blends of the two polycarbonates.

AS4000 is marketed as a material that requires a primer layer while PHC587 is marketed as a similar material to AS4000 that does not require a primer layer. In our overcoat work, both materials were shown to have outstanding wear properties in the printer both with good electrostatic properties. Furthermore, neither of these materials required a primer for our photoconductor overcoats. Presumably, this is because we are over coating a polycarbonate formulation rather than a pure polymer material.

Comparative Examples. Experiments were also conducted with two comparable, silsesquioxane coating products from GE Silicones without an UV absorber: SHC 1200 and SHC5020. Compared to the overcoats of the present invention with an UV absorber, PC drums coated with these materials without an UV absorber exhibited a high loss in mobility, which significantly altered the electrophotographic properties of the PC drum.

Accordingly, variations in implementation with respect to this invention consistent with the foregoing can be anticipated.

What is claimed is:

1. A photoconductor overcoated with a silsesquioxane substituted with a hydrolyzed benzophenone having the following general formula:

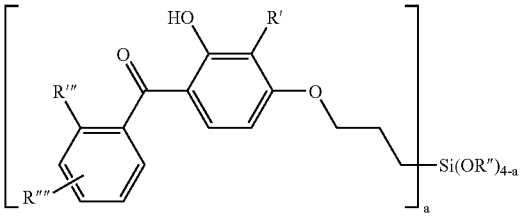

where R' is hydrogen $C_1$-$C_8$ alkyl or halogen, R''' and R'''' are hydrogen, $C_1$-$C_8$ alkoxy, carboxy, halogen, hydrogen, amino, carbethoxy, or -Q- $(CH_2)_3Si(OR'')_3$; Q is —NH—or —O—; R'' is $C_1$-$C_8$ alkyl; and a is an integer equal to 1-3 inclusive.

2. The overcoated photoconductor of claim 1 in which said hydrolyzed benzophenone substitutes said silsesquioxane in amount of about one said benzophenone-containing group for every 4 to 10 methyl substituted silicon groups.

3. The overcoated photoconductor of claim 1 in which said overcoat is between 0.1 and 5 microns thick.

4. The overcoated photoconductor of claim 1 in which said overcoat is between 0.5 and 2 microns thick.

5. The overcoated photoconductor of claim 1 in which said overcoat is about 0.75 microns thick.

6. A photoconductor overcoated with a silsesquioxane substituted with hydrolyzed 4-[3-triethoxysilylpropoxy]-2-hydroxybenzophenone (SHBP).

7. The overcoated photoconductor of claim 6 wherein said SHBP substitutes said silsesquioxane in amount of about one said SHBP molecule for every 4 to 10 methyl substituted silicon groups.

8. The overcoated photoconductor of claim 7 in which said overcoat is between 0.5 and 2 microns thick.

9. The overcoated photoconductor of claim 7 in which said overcoat is between 0.1 and 5 microns thick.

10. The overcoated photoconductor of claim 7 in which said overcoat is about 0.75 microns thick.

11. The overcoated photoconductor of claim 6 in which said overcoat is between 0.1 and 5 microns thick.

12. The overcoated photoconductor of claim 6 in which said overcoat is between 0.5 and 2 microns thick.

13. The overcoated photoconductor of claim 6 in which said overcoat is about 0.75 microns thick.

* * * * *